US007195086B2

(12) United States Patent
Aaron et al.

(10) Patent No.: US 7,195,086 B2
(45) Date of Patent: Mar. 27, 2007

(54) ANTI-TRACKING EARTH BORING BIT WITH SELECTED VARIED PITCH FOR OVERBREAK OPTIMIZATION AND VIBRATION REDUCTION

(76) Inventors: Anna Victorovna Aaron, 5117 Presley Dr., Flowery Branch, GA (US) 30542; Viktor Lytvynenko, Kosigina Street 7/41, Krivoy Rog, Dnepropetrovsk Region (UA) 50082

( * ) Notice: Subject to any disclaimer, the term of this patent is extended or adjusted under 35 U.S.C. 154(b) by 16 days.

(21) Appl. No.: 10/768,532

(22) Filed: Jan. 30, 2004

(65) Prior Publication Data

US 2005/0167161 A1 Aug. 4, 2005

(51) Int. Cl.
*E21B 10/16* (2006.01)

(52) U.S. Cl. ..... 175/374; 175/376

(58) Field of Classification Search ..... 175/374, 175/376, 426; 703/10
See application file for complete search history.

(56) References Cited

U.S. PATENT DOCUMENTS

| | | | | |
|---|---|---|---|---|
| 1,708,288 | A * | 4/1929 | Wadsworth | 175/353 |
| 3,726,350 | A | 4/1973 | Pessier | |
| 4,187,922 | A * | 2/1980 | Phelps | 175/374 |
| 4,202,419 | A * | 5/1980 | Youngblood | 175/374 |
| 4,393,948 | A | 7/1983 | Fernandez | |
| 4,427,081 | A | 1/1984 | Crawford | |
| 4,815,342 | A | 3/1989 | Brett et al. | |
| 5,197,555 | A | 3/1993 | Estes | |
| 5,224,560 | A | 7/1993 | Fernandez | |
| 5,372,210 | A | 12/1994 | Harrell | |
| 5,415,030 | A | 5/1995 | Jogi et al. | |
| 5,704,436 | A | 1/1998 | Smith et al. | |
| 5,730,234 | A | 3/1998 | Putot | |
| 5,767,399 | A | 6/1998 | Smith et al. | |
| 5,794,720 | A | 8/1998 | Smith et al. | |
| 6,095,262 | A | 8/2000 | Chen | |
| 6,213,225 | B1 | 4/2001 | Chen | |
| 6,401,839 | B1 | 6/2002 | Chen | |
| 6,412,577 | B1 | 7/2002 | Chen | |
| 6,516,293 | B1 | 2/2003 | Huange et al. | |
| 2003/0051918 | A1 | 3/2003 | Chen | |
| 2004/0230413 | A1 * | 11/2004 | Chen | 703/10 |

* cited by examiner

*Primary Examiner*—William P. Neuder

(57) ABSTRACT

An earth boring drill bit is constructed having rotatable cutter for forming a borehole in earth. At least one circumferential row of cutting elements is optimized to create overbreak of rock and eliminate tracking, wherein selected pitches have mathematically determined pairs and the absolute difference between the selected pitch and its pair is greater than 10% of the difference between maximum and minimum pitch for that circumferential row. Furthermore, cutting elements are placed along pre-selected generatrices with deviation from said generatrices, which is less than half the maximum pitch of circumferential rows occupied by said cutting element. The present invention eliminates tracking and reduces detrimental axial resonance frequency vibration while reducing cutting element count, including tungsten-carbide inserts, as compared to conventional roller cutter drill bits used for oil, gas and shot hole drilling wells and simultaneously increases footage drilled, drilling speed, and durability.

16 Claims, 12 Drawing Sheets

ANTI-TRACKING EARTH BORING BIT WITH SELECTED VARIED PITCH FOR OVERBREAK OPTIMIZATION AND VIBRATION REDUCTION

BACKGROUND OF THE INVENTION

1. Technical Field

The present invention is related to drill bits for boring earthen formations. The present invention is particularly adapted for rolling cutter earth-boring bits most typically used in oil and gas drilling, but also has application in bits used in blast hole and mining applications.

2. Summary of the Prior Art

In 1909, Howard R. Hughes invented the rolling cutter rock bit, which revolutionized the exploration and drilling of oil and gas wells. Since that time, countless improvements have been made to Hughes' basic design.

One problem that remains to be solved is that of "tracking." Tracking occurs when a cutting element (tungsten-carbide insert or steel tooth) falls in the same impression that was made previously by the same or another cutting element. This results in loss of drilling efficiency since the primary mode of contact between cutters and formation is between the surface of the cutter and formation rather than between the cutting elements and formation. This results in increased wear of the bit as well as reduction in feet per hour or penetration rate.

Conventional solutions to tracking include increasing the weight-on-bit (WOB), but, as can be expected, this reduces bit life because of the additional strain on bit components. Probably the most common way to reduce tracking and vibration is to decrease the pitch between adjacent cutting elements or increase cutting element count, especially for hard rock formations as shown in U.S. Pat. Nos. 6,161,634 and 3,726,350. The disadvantage of such solutions is that overbreak effect is not utilized, specific energy increases and the cost of the drill bit is augmented.

Tracking also can be partially reduced by increasing sliding and scraping of cutting elements on the bottom hole by adjusting the geometry of the bit. The drawback of this approach is that the cutting elements that are sliding and scraping will wear faster while tracking will not be completely eliminated.

Another solution to the tracking problem is the use of varying pitch (angular distance between the centerlines) between the cutting elements for instance as proposed in U.S. Pat. Nos. 4,248,314, 4,187,922 and 3,726,350. Any deviation from equal pitch, can dramatically increase bit vibration, again causing premature bit wear. Moreover, merely randomly varied pitch drill bits can track just as much as equally spaced drill bits.

Tracking can also be reduced through various configurations of cutting elements or teeth, including teeth with "T" shape crest for additional wear resistance wherein the teeth/inserts crush the formation to reduce tracking (for example see UK Patent number 3,326,307). This approach tends to reduce drilling speed and increases specific energy (energy applied per unit of formation broken) because the cutting elements crush the formation with lower penetration rate. Another variation is to group and space cutting elements with varied pitches between groups in combination with changing the orientation of the cutting element crests for various groups. (See for example UK Patent 1,896,251). These approaches may reduce tracking; however they increase manufacturing cost. See U.S. Pat. No. 2,333,746. A change in cutting element orientation as shown in U.S. Pat. No. 4,393,948 without optimal placement on the surface of the cutters can only reduce but not completely eliminate tracking.

Methods to optimize drill bit performance using simulations and other statistical data to improve performance parameters of the bit are illustrated in U.S. Pat. Nos. 6,213,225; 6,095,262; 6,516,293; and published patent applications 20,030,051,917; 20,030,051,918; 20,010,037,902. Ad hoc simulation approaches are best implemented in the absence of adequate theory; however, statistical optimization results are limited by the assumptions and biases taken at the beginning of the optimization process. Furthermore, prior-art simulation methods have over-inflated the cutting element count required to optimally drill earthen formations.

A need exists, therefore, for an earth-boring bit having anti-tracking characteristics that avoids excessive vibration and can be economically produced.

One common drawback of all the prior art solutions is lack of overbreak optimization during drilling of rock formation. The overbreak effect is the investigation of the fact that rock has strong compression properties and has weak bending and distention properties as compared to metal, for instance iron.

Another common drawback all the prior art solutions is misunderstanding by those knowledgeable in the art of actual cause for detrimental axial resonance frequency vibration of the cutter drill bit by boring rock. Inventors found the actual cause for detrimental axial resonance frequency vibration for roller cutter drill bits for the first time since long history of improvements made to Hughes' basic roller cutter drill bits; found cause is eliminated in the present invention.

SUMMARY OF THE INVENTION

The main object of the invention is creation of earth-boring roller cutter drilling tool design which simultaneously increases footage drilled, durability and rate of penetration while reducing the number of cutting element count, in one embodiment tungsten-carbide inserts, compared to conventional earth-boring roller cutter drilling tools which are presently manufactured around the globe.

Another object of the present invention is modification of conventional designs of roller cutter drill bits to simultaneously increase footage drilled, durability and rate of penetration while reducing the cutting element count compared conventional earth-boring roller cutter drilling tools which are presently manufactured around the globe.

The above mentioned objects can be achieved according to the proposed invention via mathematically determined optimal placement of cutting elements on the surface of each cutter rotatably mounted on a drill tool or drill bit through simultaneous utilization of the following concepts:

1. Complete elimination of tracking during drilling on the bottom hole by means of independent rolling cutter with use of varied pitch between adjacent cutting elements.
2. Maximization of volume of formation broken due to optimization of overbreak through optimal spacing between subsequent penetrations taking into account mechanical properties of rock to be drilled and the geometry of cutting elements and orientation of cutting elements centerline with respect to the surface of the cutter.
3. Substantial reduction of detrimental axial resonance frequency vibration of drill bit or tool which are restrictive to the process of drilling the formation through optimal placement of cutting elements along cutter generatrices.

DETAILED DESCRIPTION OF THE INVENTION

Figure 1:
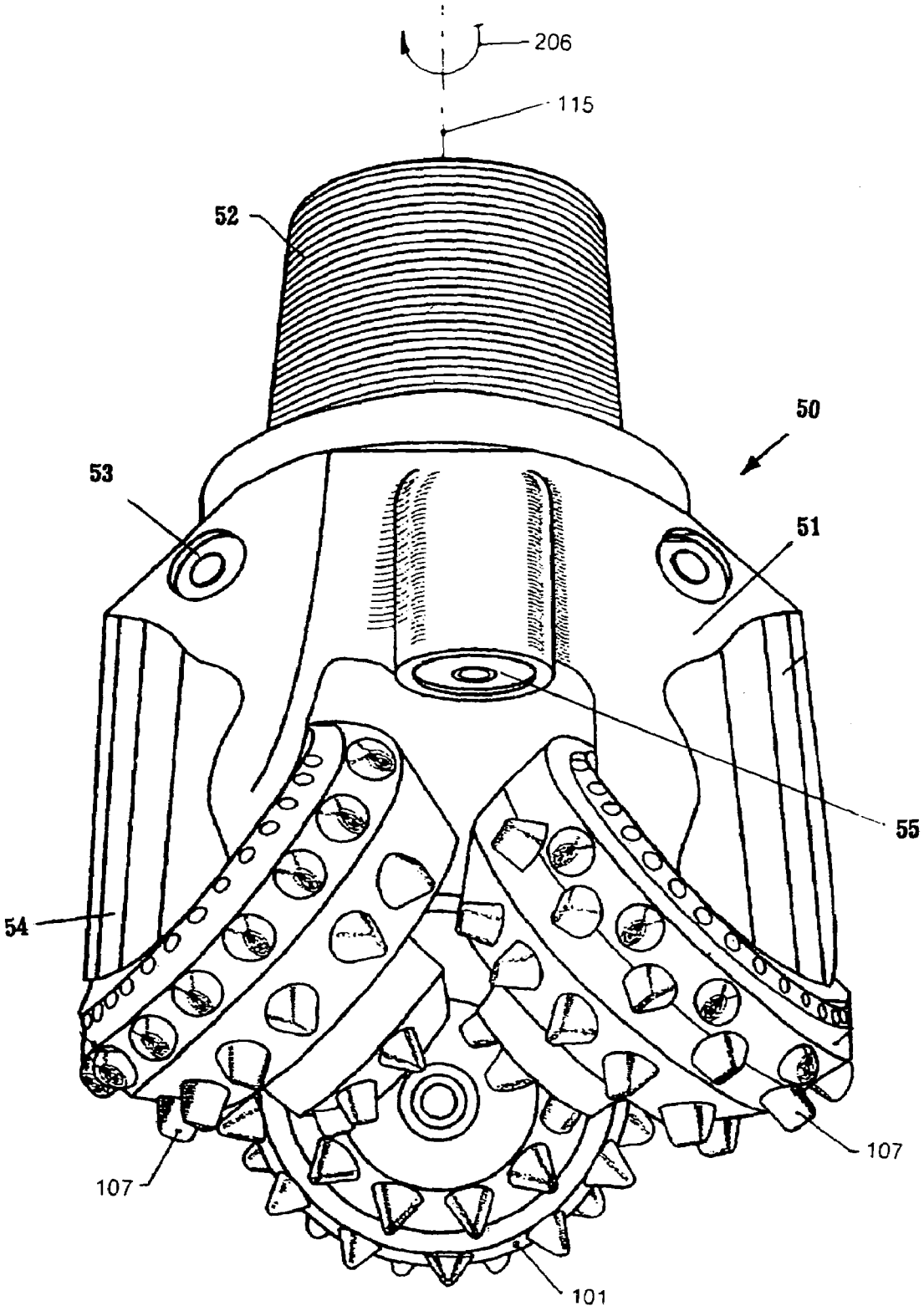
FIG. 1 (Prior Art)
FIG. 1 is a perspective view of a prior-art rolling cone drill bit that is of the general type contemplated by the present invention.
Figure 4:
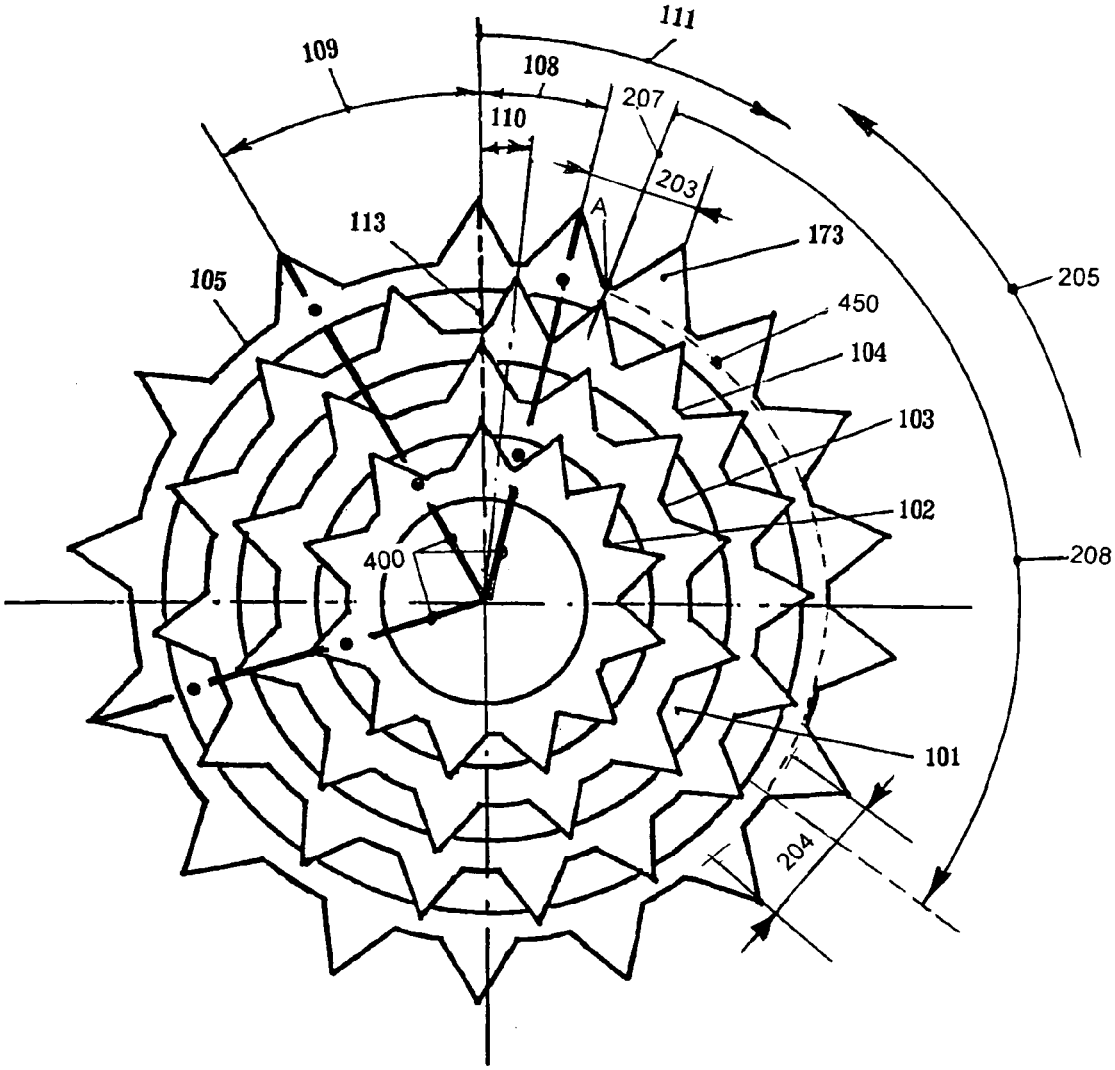
FIG. 4 is a schematic layout showing a preferred arrangement of cutting elements comprising milled teeth.

Referring now to the FIGS., and specifically to FIG. 1, a conventional rolling cutter (also called rolling-cone or three-cone) drill bit 50 conventionally used for drilling a bore in an earthen formation is illustrated. Bit 50 is typical of those contemplated by the present invention. Bit 50 comprises a bit body 51 that is threaded at its upper extent 52 for connection into a drill string. Bit 50 optionally may be provided with a lubricant compensator 53. A nozzle 55 is provided in bit body 51 to cool and lubricate the drill bit during drilling. Bearing pins or arms 54 extend from bit body in a cantilevered, downwardly depending fashion. At least one cutter 101 is mounted on bit arm 54 and is carried for rotation by each section of bit body with a plurality of cutting elements 107 thereon arranged in generally circumferential rows. Tungsten-carbide inserts 107 are secured by interference fit in holes or apertures formed in cutters 101 to define the cutting elements. The cutting elements may also be formed of the material of the cutter 173 (a steel-tooth bit) as shown in FIG. 4. When connected into a drillstring, bit 50 is rotated about its axis 115 in the direction 206 to disintegrate earthen formations.

Figure 2:
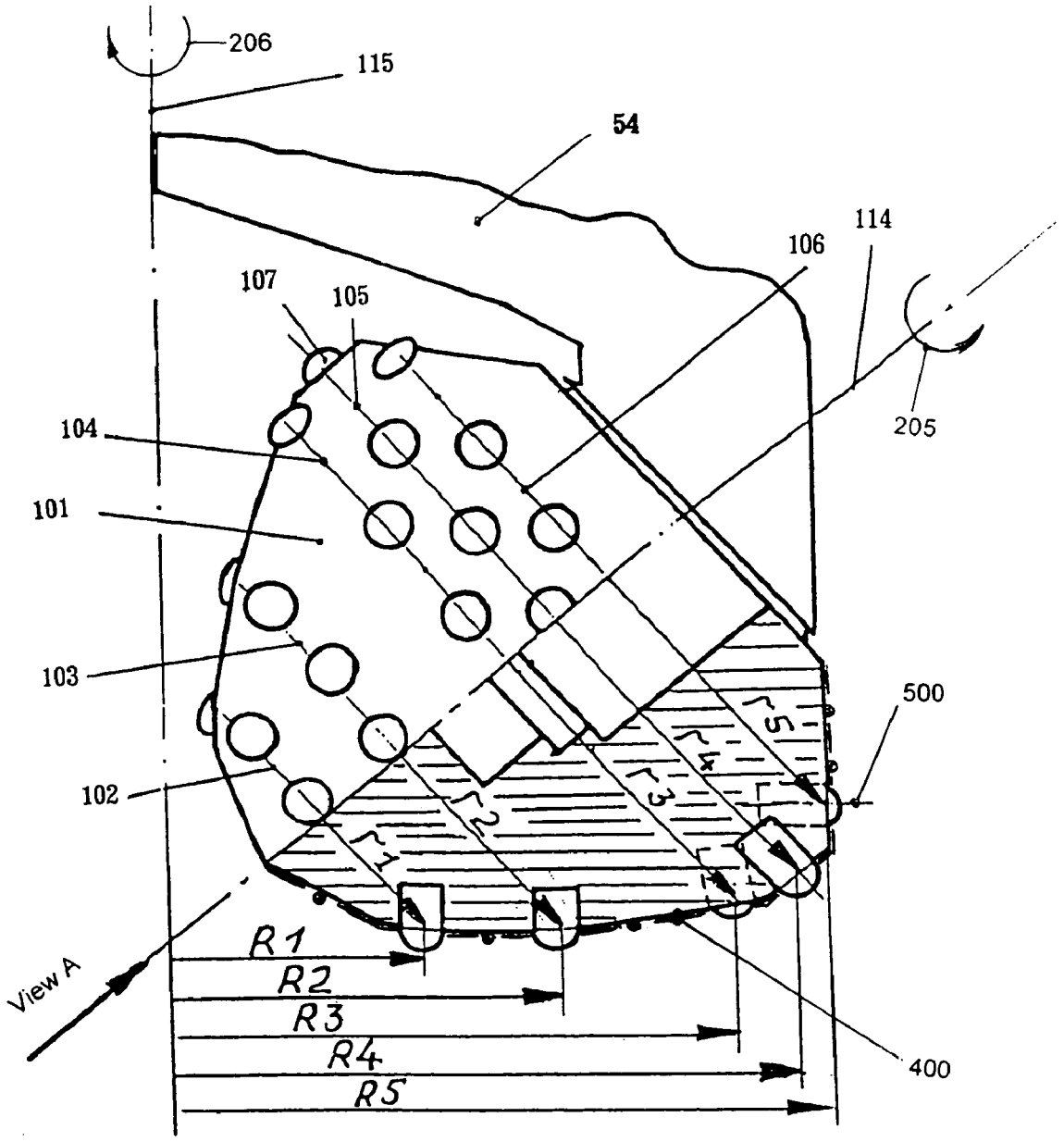
FIG. 2 shows a side view of a cutter designed according to the teaching of the present invention.

Referring to FIG. 2, a side view of multi-cone rolling cutter 101 according to the teachings of present invention is illustrated. The cutter 101 comprises a multiplicity of cutting elements, in one embodiment tungsten-carbide inserts 107, embedded in insert holes formed in the body of the cone and arranged in generally circumferential rows 102–106 about the axis 114 of the cutter. Geometrical parameters of cutting elements 107 can be different in shape, size, and orientation of the crest.

Each cutting element 107 has its centerline 500; centerline 500 simultaneously intersects the surface of the cutter and the circumferential row in which the cutting element is placed. Pitch is defined as the length of arc in circumferential row between points of intersection of centerlines 500 with circumferential row curve on the cutter 101 surface for adjacent cutting elements along the circumferential row or alternatively defined as the angle between adjacent cutting elements' axes 500 for each circumferential row.

Radiuses r1–r5 of each circumferential row are defined as the shortest distance from the cutter axis 114 to the any point in circumferential rows 102–106 on the surface of the cutter 101. Radiuses R1–R5 are the maximum distance from a selected point of circumferential row to the axis 115 of the drill bit 50 measured perpendicular to axis 115 of the drill bit 50. It is conventionally known that the ratio Kv defined as Ri divided by ri should not be equal to an integer to reduce tracking, where i=1, 2, 3 . . .

100% tracking is achieved in cases where Kv ratio is equal to an integer regardless of pitch selection between cutting elements 107. In order to avoid tracking with varied pitch and optimize overbreak of formation, the decimal part of Kv is preferably in the 0.3–0.7 range. Overbreak optimization of the cutter 101 according to the teachings of the present invention mathematically determines optimum pitch between the cutting elements 107 arranged in circumferential rows to produce the largest chips possible for selected cutters 101 and formations to be drilled. The larger the chips, the more rock formation is removed per unit of energy and the greater is cost reduction, time and energy savings. Placement of cutting elements 107 closer than this optimum distance results in less volume broken per unit of energy; subsequent penetration farther than this optimum distance results in increased power consumption as chipping is replaced by indentation.

The cutter 101 is mounted on the bit arm 54 and is rotated about bit central axis 115 in the direction 206. Multiplicity the generatrices 400 defined as the geometric locus on the surface of the cutter 101 formed when the plane containing the central axis 114 of the cutter 101 intercrosses the centerline 500 of at least one selected cutting element 107 and the geometric surface of the cutter 101. In other words, a generatrix is a curve that forms the surface of the cutter as it is rotated about the cutter's axis. At each moment during drilling, main force interactions between the cutter 101 and formation being disintegrated occur along a generatrix 400. Therefore, optimal placement of cutting elements with respect to their density along generatrices is crucial for reduction of harmful vibration.

Figure 3:
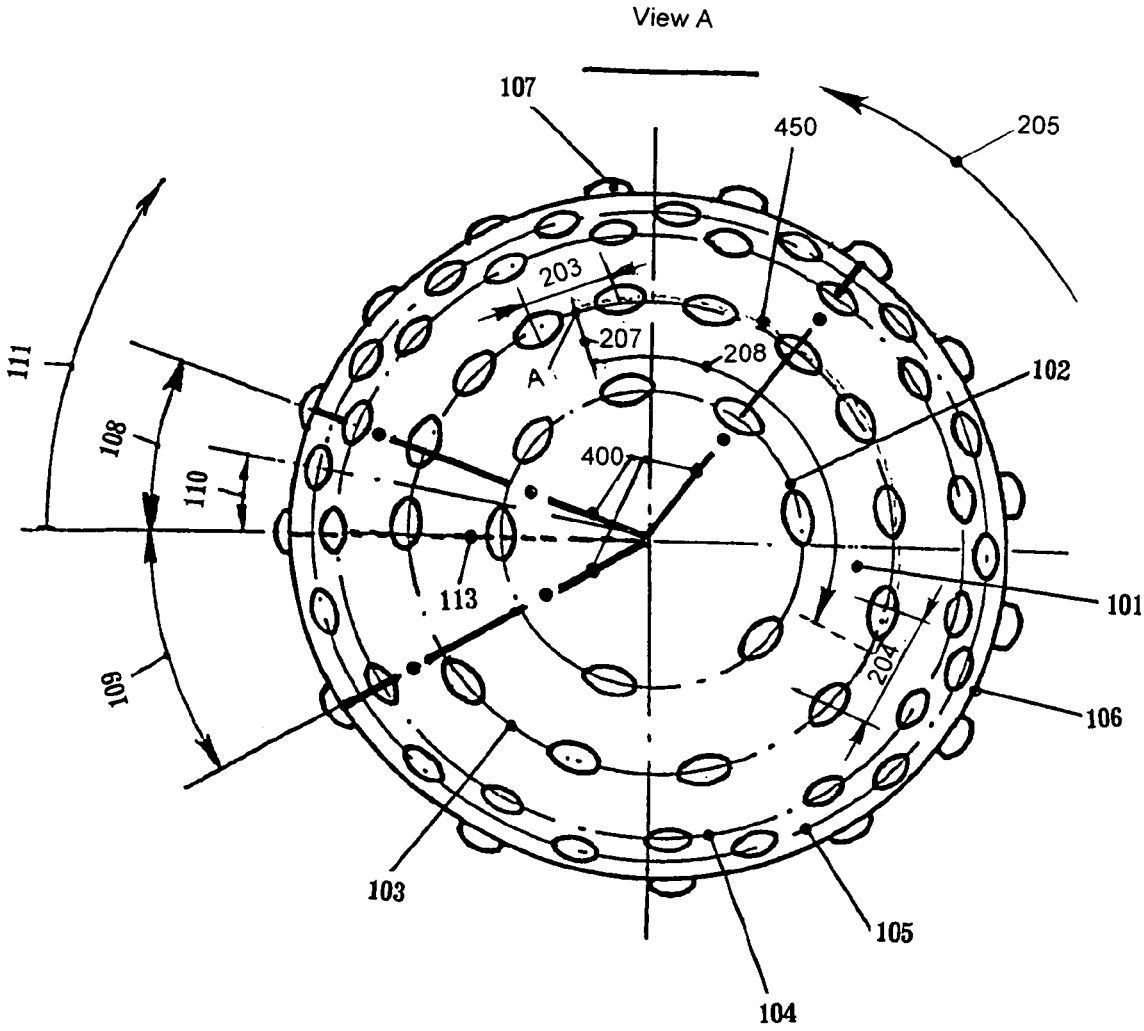
FIG. 3 is a schematic drawing illustrating a preferred arrangement of tungsten-carbide inserts on the surface of the cutting member according to the teachings of present invention.

Referring now to FIG. 3, which depicts View A, looking upwardly at the cutting structure, the pitches between the cutting elements 107, defined as the angle between adjacent cutting elements' axis 500, on each circumferential row, are progressively increasing from minimum pitch 108 to the maximum pitch 109, moreover, all pitches are different and the minimum pitch 108 and the maximum pitch 109 are adjacent to each other. Additionally, the minimum pitches 108 on all circumferential rows 102-106 start along a randomly chosen generatrix 113 of the rolling cutter member 101; furthermore, the deviation from the generatrix 113 cannot exceed 45 degrees and is preferably less than half the minimum pitch 110. The same direction 111 is maintained for all circumferential rows 102–106 of said cutting member 101 from said minimum pitches 108 starting along said generatrix 113 and increasing to maximum pitches 109.

The minimal pitches 108 in all circumferential rows 102–106 of said cutting member 101 could be equal or different. The maximum pitches 109 and on all circumferential rows 102–106 of said cone 101 could be equal or different. The increase from the minimal pitch 108 to the maximum pitch 109 can be defined as arithmetical, geometrical, exponential, logarithmical or any other mathematical function or a combination thereof.

For illustrative purposes, several generatrices 400 are shown along which cutting elements 107 in each circumferential row 102–106 are being aligned with deviation from generatrices 400 less than half the selected maximum pitch 109 of the circumferential row occupied by the cutting element 107.

To illustrate selection of optimal varied pitch for overbreak optimization according to the teachings of the present invention, for circumferential row 103 pitch 203 is selected and its pair varied pitch 204 is computed as detailed below. Arc 450 shown as a dashed curve is a part of the circumferential row 103. The arc 450 is measured from point A defined as midpoint of selected pitch 203 in circumferential row 103 in the direction 208, which is opposite to the direction 205 of cutter 101 rotation. The origin of direction 208 is line 207, which intersects pitch 203 at midpoint A. The end of arc 450 falls within a certain pitch, labelled computed pitch 204. The arc 450 denoted as L equals to the length of said circumferential row 103 (2*ρ*r2) multiplied by the decimal part of Kv which will be denoted as KvD for the purposes of present invention. For instance, for r=5 units and R=7 units, Kv equals 7 divided by 5 or 1.4. The decimal part of Kv denoted as KvD equals 0.4.

$$L=KvD*(2*\rho*r2)$$

KvD may not equal zero to avoid tracking and may be within from 0.15 to 0.85. KvD is preferably in the 0.3–0.7 range. The overbreak effect of rock formation during drilling exists when the absolute difference between selected pitch 203 and its computed pair varied pitch 204 is greater than 10% of the absolute difference between maximum pitch 109 and minimum pitch 108, both of which are selected for circumferential row 103. The above definition for circumferential row 103 can be restated in mathematical form:

$$|203-204|>0.1*|109-108|$$

In one class of embodiments according to the principals of the current invention, the pitches are calculated as an arithmetical progression of the form "minimal pitch" +D*n, wherein D is a constant which is determined as the optimal value to maximize overbreak effect and n is a consecutive positive integer (n=1, 2, 3 . . . )

Yet in another class of the embodiments according to the principals of the current invention, D can be varied such as to allow optimal placement of the cutting elements to reduce vibration.

Referring now to FIG. 4, the cutter is illustrated according to the teachings of the present invention. Annotations similar to those in FIG. 3 are used except in this embodiment of the present invention cutting elements are made of the same material as the cutter or milled teeth 173. For illustrative purposes, selected pitch 203 and its pair computed varied pitch 204 are illustrated for circumferential row 105 versus circumferential row 103 in FIG. 3. The overbreak effect of rock formation during drilling exists when the absolute difference between selected pitch 203 and its calculated pair varied pitch 204 is greater than 10% of the absolute difference between maximum pitch 109 and minimum pitch 108, both of which are selected for circumferential row 105. The above definition for circumferential row 105 can be restated in mathematical form:

$$|203-204|>0.1*|109-108|$$

To illustrate selection of optimal varied pitch for overbreak optimization according to the teachings of the present invention, for circumferential row 105 select pitch 203 and compute its pair varied pitch 204. Arc 450 shown as a dashed curve is a part of the circumferential row 105. The arc 450 is measured from the point A defined as midpoint of selected pitch 203 in circumferential row 105 in the direction 208, which is opposite to the direction 205 of cutter 101 rotation. The end of arc 450 falls within a certain pitch, labelled computed pitch 204. The arc 450 denoted as L equals to the length of said circumferential row 105 (2*ρ*r2) multiplied by the decimal part of Kv which will be denoted as KvD.

$$L=KvD*(2*\rho*r4)$$

Figure 5:
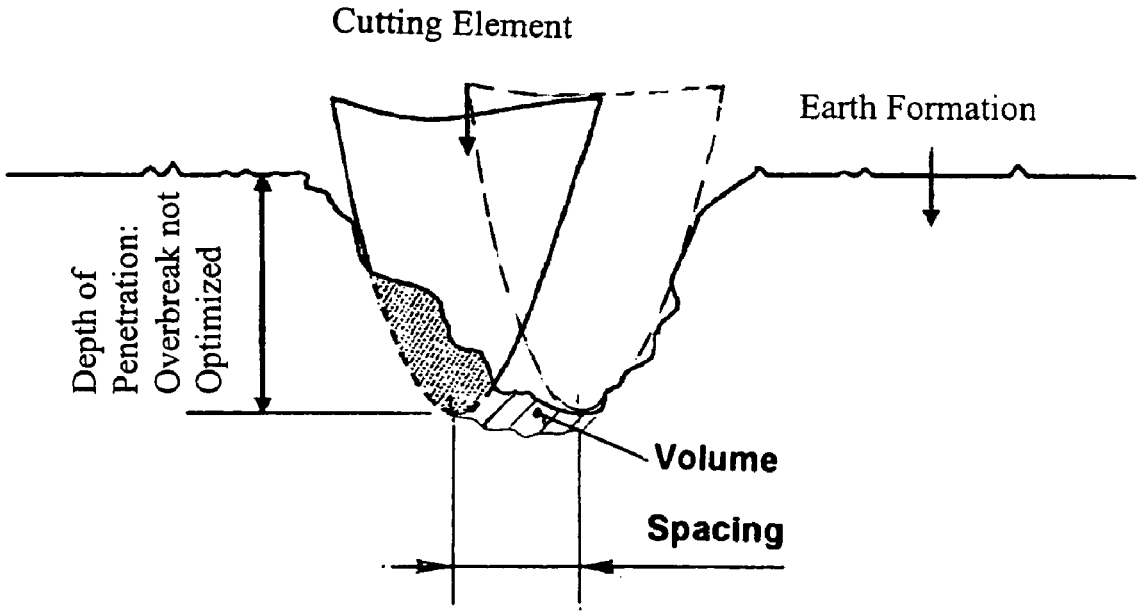
FIG. 5 (Prior Art)
FIG. 5 shows volume of formation broken without overbreak optimization (prior art).

FIG. 5 illustrates the volume of the formation broken without overbreak optimization (prior art). If the spacing between previous and subsequent penetrations of cutting elements is not optimized, the volume of the formation broken and depth of penetration are insignificant lacking overbreak effect. Based on the definition of overbreak according to the teachings of the present invention, it is impossible to create overbreak with constant pitch conventionally used in roller cutter drill bits of prior art.

Figure 6:
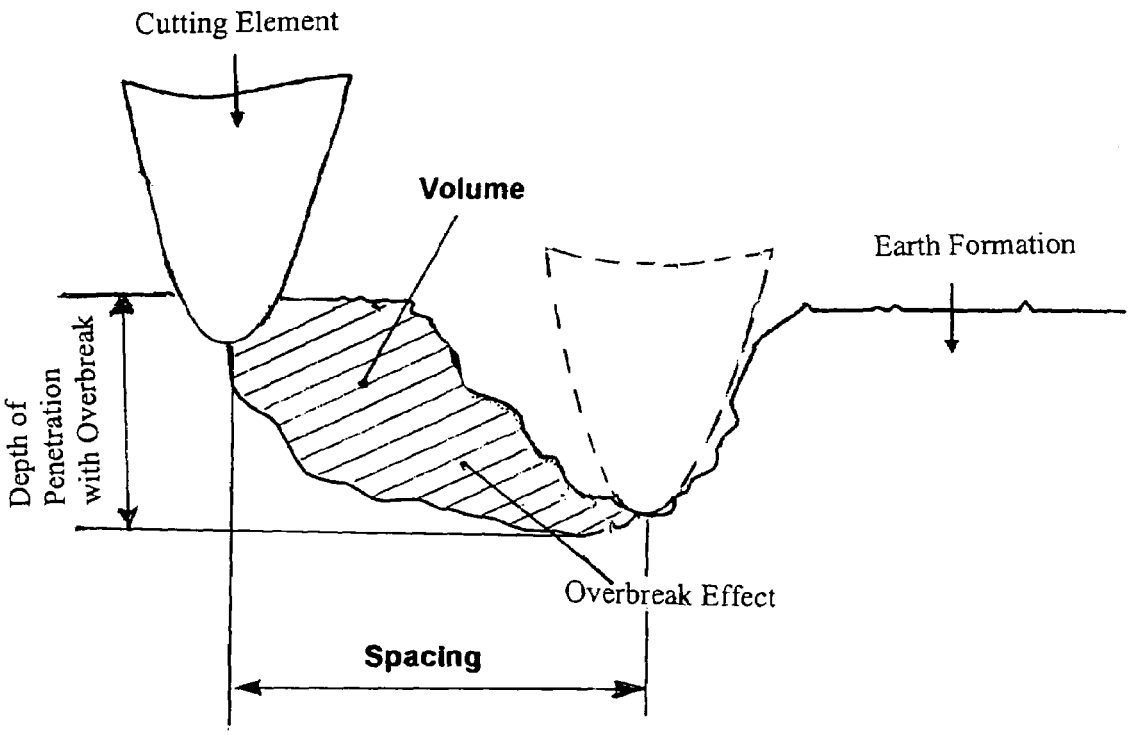
FIG. 6 shows volume of formation broken with overbreak due to optimal spacing between previous and subsequent penetrations of cutting elements in rock.

Referring now to FIG. 6 volume of the formation broken with overbreak due to optimal spacing between previous and subsequent penetrations of cutting elements is shown. Overbreak is optimized for a given circumferential row when at least 20% of pitches have mathematically determined pair, which satisfy the definition of overbreak according to the teachings of the present invention. In one preferred embodiment, all pitches of given circumferential row have a pair satisfying the definition of overbreak according to the teachings of the present invention.

Figure 7:
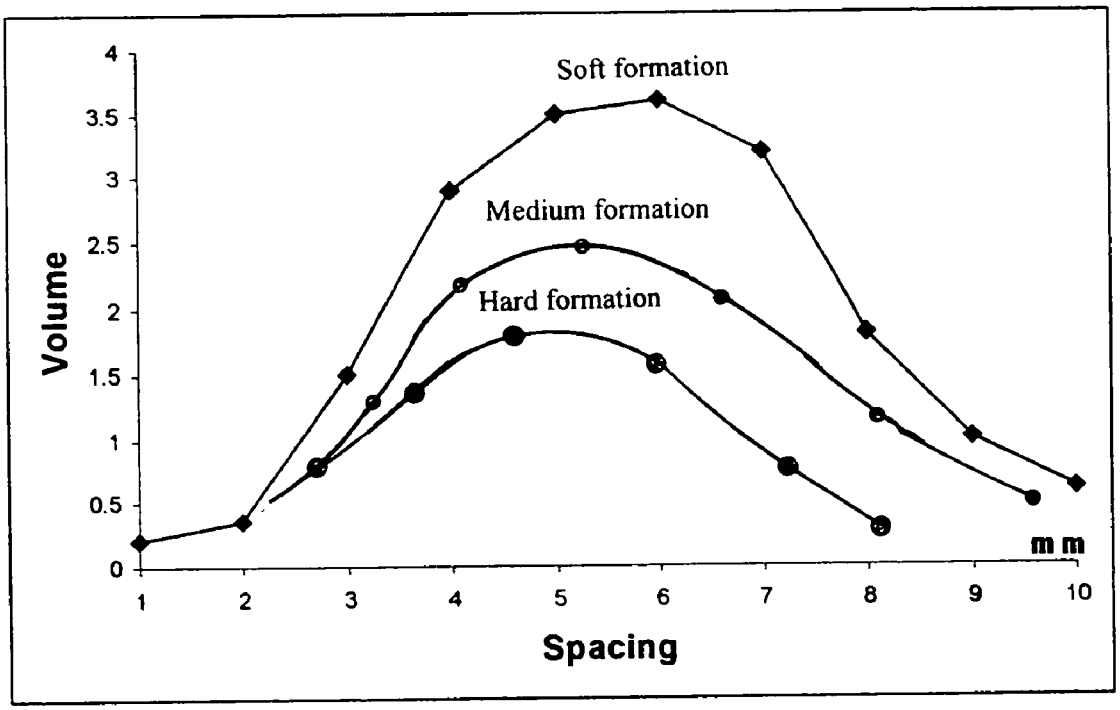
FIG. 7 illustrates volume of formation broken as a generally convex function of spacing between previous and subsequent penetrations of cutting elements for a given formation.

FIG. 7 illustrates volume of formation broken as a generally convex function of spacing between previous and subsequent penetrations of cutting elements for a given formation. Each type of formation has its own spacing-volume curve (soft, medium or hard) that depends on physical and mechanical properties of formation for given type of cutting elements and drilling conditions. Overbreak is optimized when volume of formation broken is maximized.

Figure 8:
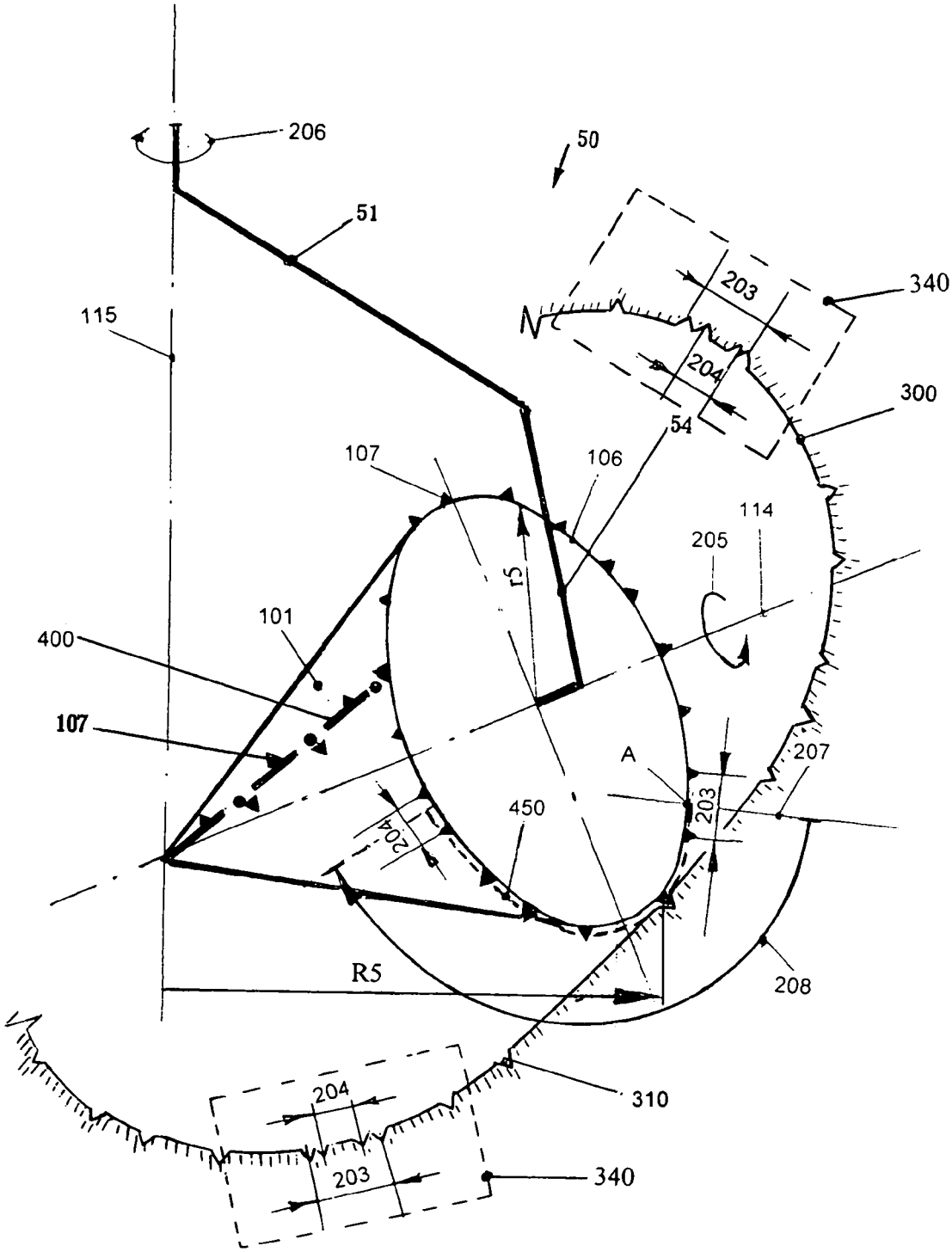
FIG. 8 is a schematic layout showing placement of mathematically determined pitch pairs in a circumferential row according to the teachings of the present invention.

Referring now to FIG. 8, a schematic layout of a single-cone rolling cutter 101 and placement of mathematically determined pitch 204 with respect to selected pitch 203 of circumferential row 106 is illustrated according to the teachings of the present invention as described in FIGS. 1–3.

The cutting element 107 of the circumferential row 106 of the cutter 101 interacts with the bottom hole along path 300 making impressions 310 in the bottom hole resulting from penetration of cutting elements during the drilling process. The distance between adjacent the impressions 310 on the circular path 300 with radius R5 is equal to the distance between respective adjacent cutting elements 107 on the circumferential row 106. If the pair of pitches 203 and 204 on the circumferential row 106 is calculated according of the teachings of the present invention, than for any random section 340 along path 300 penetrations of the bottom hole by cutting elements defining pitch 204 will follow penetrations of cutting elements defining pitch 203, optimal pitch difference will create overbreak effect and eliminate tracking during drilling process. Varied pitch improves scraping efficiency during formation drilling, thus even those cutting elements that are engaged in sliding fashion versus complete penetration contribute to better disintegration of formation as compared to constant pitch bits.

In one embodiment of the present invention, cutting elements 107 in all of circumferential rows of cutter 101 are being aligned along the generatrix 400 with deviation from generatrix 400 of less then 51% of the selected minimum pitch 108 for every circumferential rows occupied by cutting elements 107 resulting in substantial elimination of detrimental axial 115 resonance frequency vibration of bit 50.

If cutting elements 107 are not aligned along said generatrix 400 in accordance with the teachings of the present invention, detrimental axial resonance vibration of bit 50 offsets benefits of overbreak effect; therefore, objectives of the present invention cannot be achieved.

Figure 9:
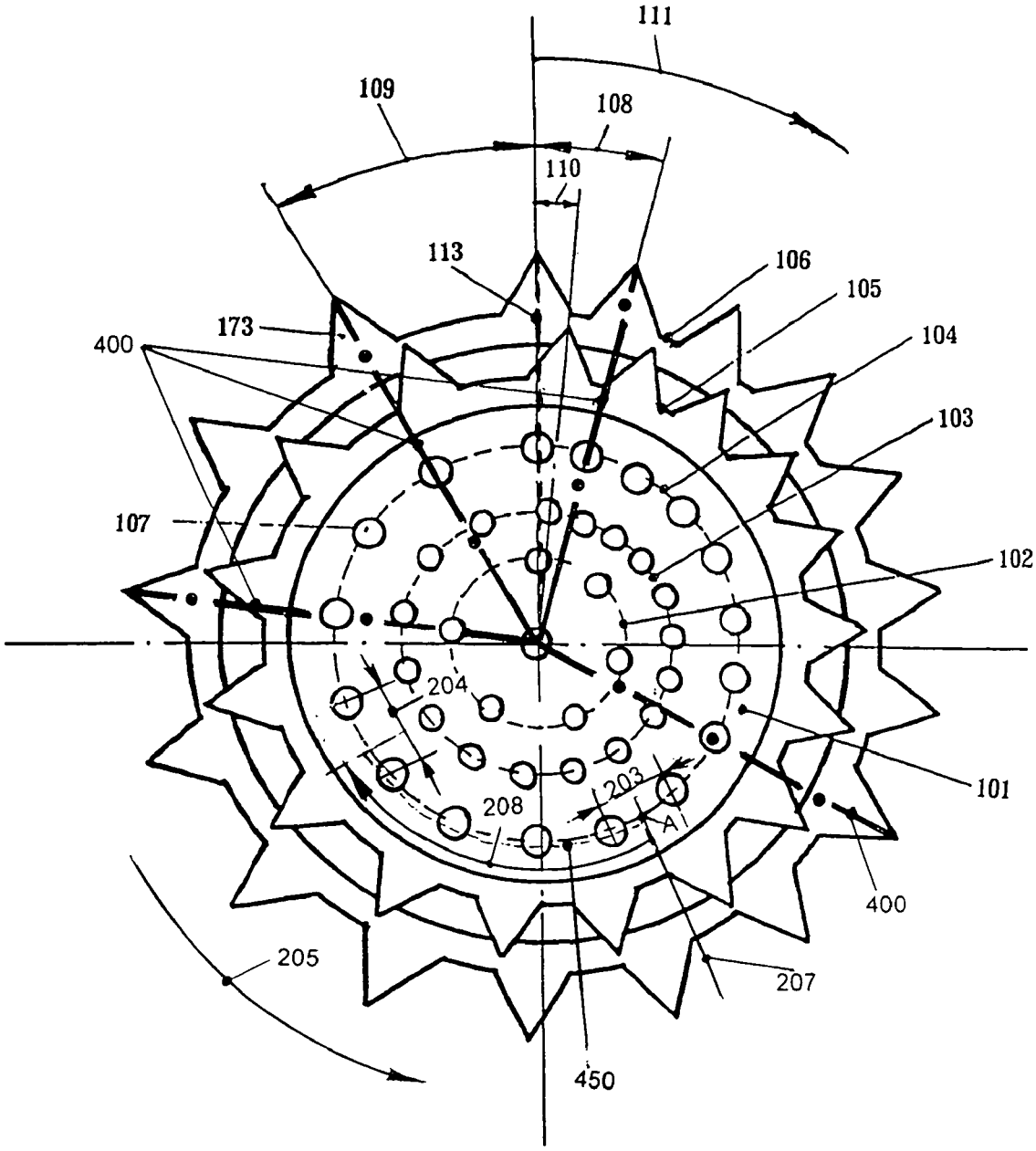
FIG. 9 is a schematic layout showing a preferred arrangement of cutting elements comprising a combination of milled teeth and tungsten-carbide inserts on the surface of the cutting member.

FIG. 9 shows another embodiment of the cutter 101 designed according to the teachings of the present invention. The cutting elements comprise both tungsten-carbide inserts 107 and milled teeth 173 and as illustrated for circumferential row 104 have selected pitch 203 and its calculated pair varied pitch 204. The beginning of minimum pitches 108 for both types of cutting elements 107 and 173 starts along one generatrix 113 for all circumferential rows of the cutter 101. Pitches in all circumferential rows progressively increase in one direction and maximum and minimum pitches for all circumferential rows are adjacent to each other. For each circumferential row maximum deviation from generatrices is less than 0.51 of the respective minimum pitch selected for that circumferential row.

Figure 10:
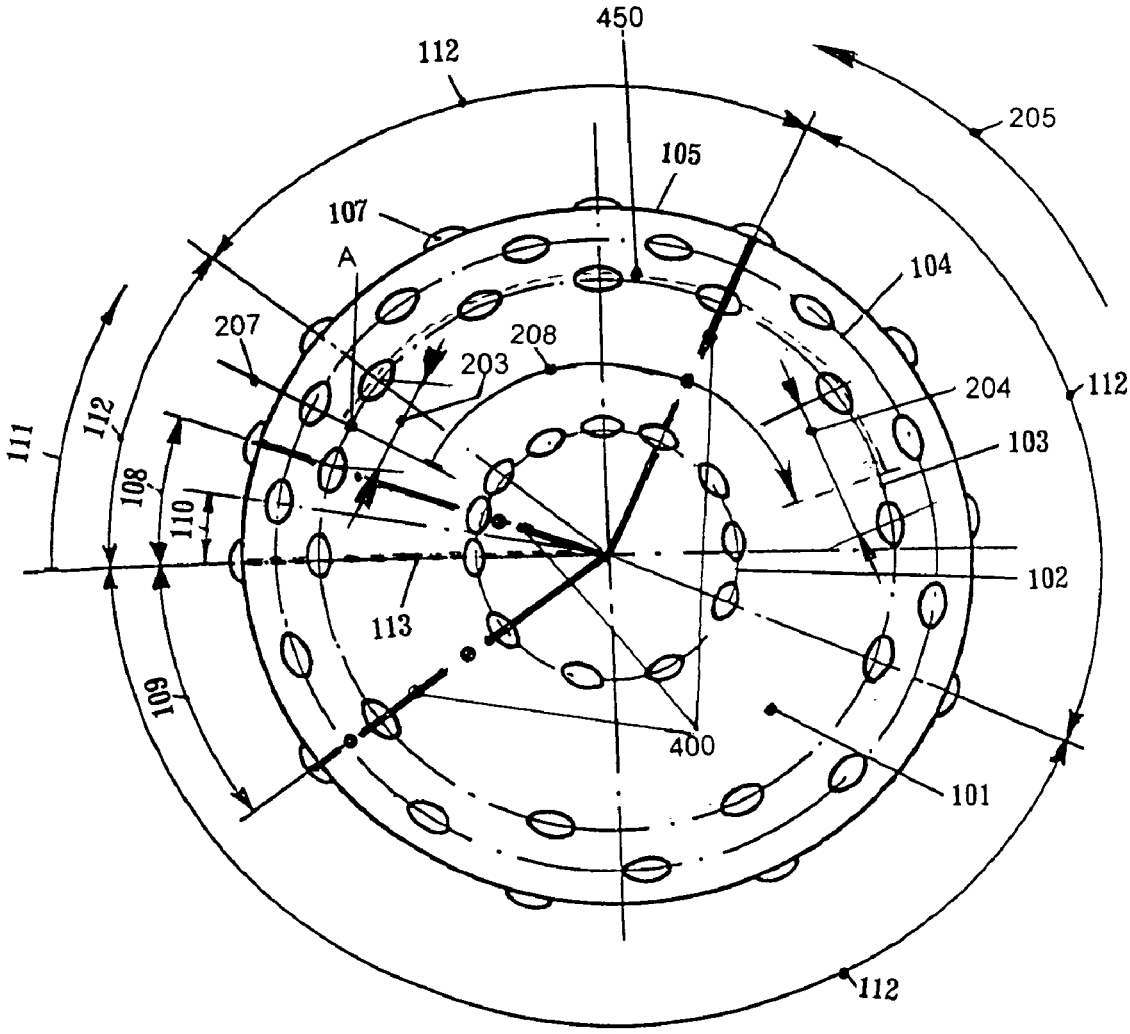
FIG. 10 is a schematic layout showing a preferred arrangement of cutting elements arranged in groups according to the teachings of the present invention.

FIG. 10 illustrates another class of the preferred embodiments, wherein cutting elements 107 are arranged in groups 112 wherein the pitch within the group is constant and the pitches between groups are varied. The direction 111 of increase in varied pitch is maintained similar for all groups; furthermore, minimal pitches 108 are adjacent to maximum pitches 109 along a chosen generatrix 113 of the cutter 101 with deviation less than 45 degrees and preferably with deviation is less than 51% of the selected minimum pitch 108.

Figure 11:
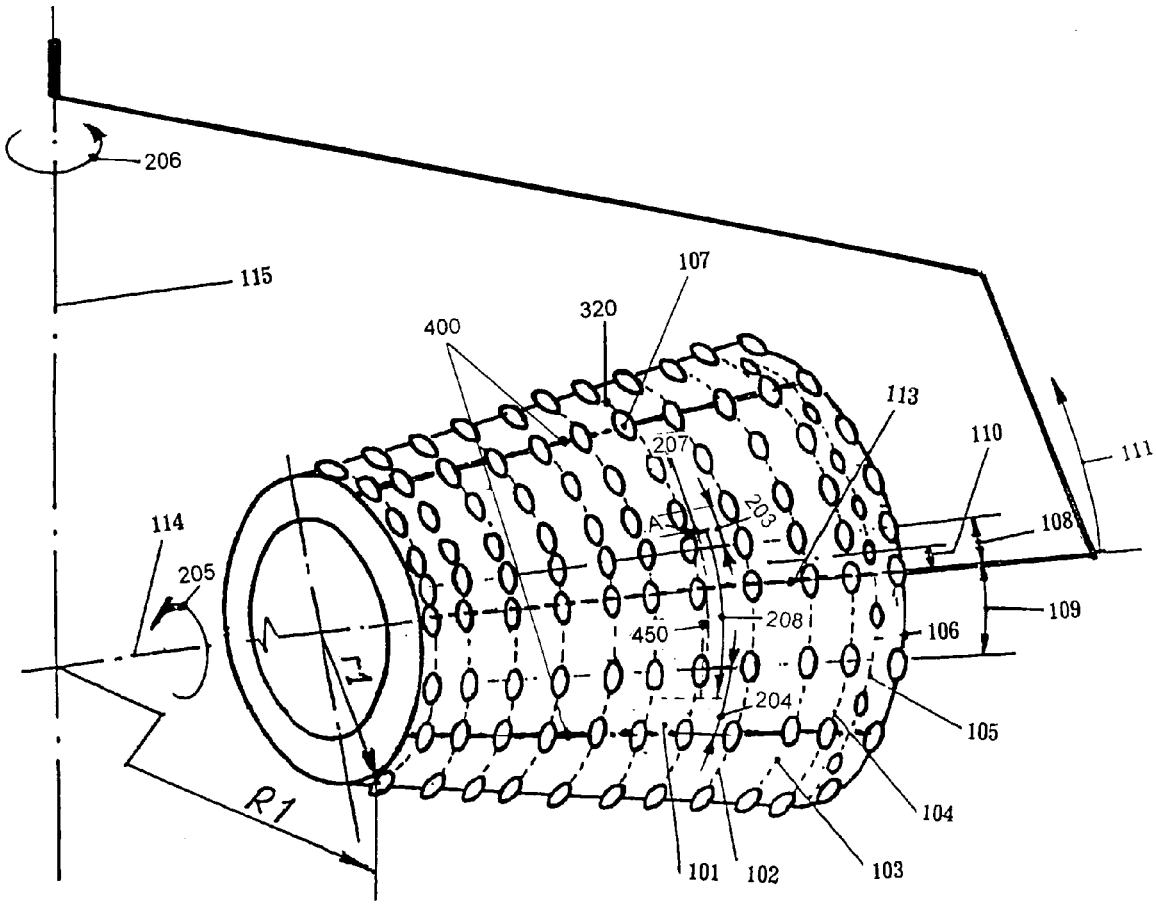
FIG. 11 is a perspective view of a cutting member constructed in accordance with the teachings of the present invention employed, for instance, by bits of the reaming type which in practice used for Tunnelling, Mining and Raise-Boring.

FIG. 11 is a schematic perspective view depicting a truncated cone 101 constructed in accordance with the teaching of the present invention as described in FIG. 2, FIG. 3, FIG. 8 which is typically used for Tunneling, Mining and Raise-Boring for instance by bits of the reaming type. For illustrative purposes, circumferential row 320 shows selected pitch 203 and its pair calculated varied pitch 204.

Figure 12:
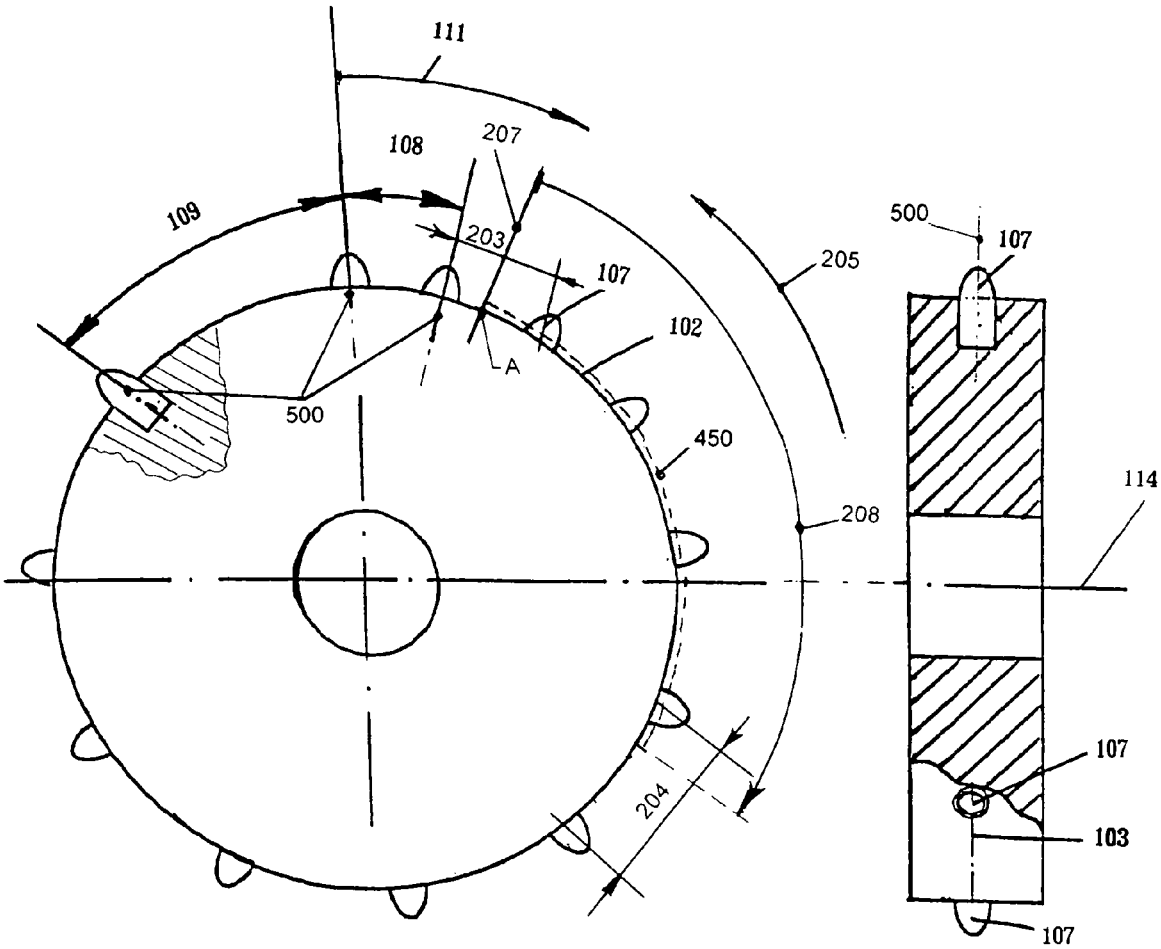
FIG. 12 is schematic layout and a perspective view showing the preferred arrangement of the cutting elements in accordance with the teachings of the present invention for rotatable cutter with one circumferential row.

FIG. 12 is a front view and a side view the cutter 101 with one circumferential row in accordance with the teaching of the present invention as described in FIG. 3. This is another embodiment according to the teachings of the present invention.

We claim:

1. An earth-boring bit, comprising:

a bit body, the bit body having a central axis of rotation;

at least one cutter rotatably mounted on said bit body, the cutter having a central axis;

a plurality of cutting elements, each cutting element having a centerline, the cutting elements arranged on the cutter in generally circumferential rows;

wherein at least one circumferential row contains varied pitch between adjacent cutting elements, having a maximum pitch and a minimal pitch;

for said row, at least 20% of pitches have a mathematically determined pair, and a difference in absolute value between said pitch and its pair is greater than 10% of a difference in absolute value between the maximum and the minimum pitch for that circumferential row, said pair pitch is determined by measuring an arc from the midpoint of said initial pitch along said circumferential row in the direction opposite to the direction of cutter rotation during drilling, said arc equals to the length of said circumferential row ($2*\pi*r$) multiplied by the decimal part of Kv $$L=2*\pi*r*KvD;$$

a plurality of generatrices, each generatrix defined as the geometric locus on the surface of the cutter formed when a plane containing the central axis of the cutter intercrosses the centerline of at least one selected cutting element and the geometric surface of the cutter; cutting elements in other circumferential rows being aligned along said generatrix with deviation from said generatrix of less than have the maximum pitch of the circumferential row occupied by the cutting element.

2. The earth-boring bit according to claim 1, wherein at least 40% of the circumferential rows have varied pitch.

3. The earth-boring bit according to claim 1, wherein, for circumferential rows with varied pitch:

mathematical relationship used for one circumferential row is scaled to mathematical relationships in other circumferential rows as a directly proportional function of radiuses, the beginnings of all mathematical relationships deviate from one selected generatrix by less than 45° and similar direction of change is chosen for all circumferential rows.

4. The earth-boring bit according to claim 1, wherein the selected mathematical relationship is an arithmetic, geometrical, weighted exponential, logarithmic progression or any other mathematical function or combination of thereof, which lead to successive increase in pitches to optimize overbreak of formation.

5. The earth-boring bit according to claim 1, wherein deviations from said generatrices are less than 51% of the selected minimum pitch of the circumferential row occupied by the cutting element.

6. The earth-boring bit according to claim 1, wherein the cutting elements are formed of the material of the cutter.

7. The earth-boring bit according to claim 1, wherein the cutting elements are formed of hard metal interference fit in apertures formed in the cutter.

8. The earth-boring bit according to claim 1, wherein the bit is a shaft boring bit.

9. The earth-boring big according to claim 1, wherein the earth-boring bit has three rotatable cutters.

10. The earth-boring bit according to claim 1, wherein the bit is a coring bit.

11. The cutter according to claim 2, wherein, at least one generatrix contains points of intersection between the centerline of cutting elements and the geometric surface of the cutter for all circumferential rows of said cutter.

12. The earth-boring bit according to claim 1, wherein, for circumferential rows with varied pitch mathematical relationship used for one circumferential row is scaled to mathematical relationships in other circumferential rows as a directly proportional function of radiuses, all mathematical relationships start from one selected generatrix and similar direction of change is chosen for all circumferential rows.

13. The earth-boring bit according to claim 1, wherein the KvD is in the 0.3–0.7 range.

14. The earth-boring bit according to claim 1, wherein pitches between cutting elements are grouped on the circumferential rows such that the pitch within a given group is constant and the pitch between the groups is progressively increasing from minimum to maximum on the circumference of said row.

15. The earth-boring bit according to claim 1, wherein, the maximum and minimum pitch are determined as a function of physical and mechanical properties of a formation.

16. The cutter according to claim 1, wherein for all circumferential rows minimal pitches start from one generatrix with deviation of less than half the minimum pitch of said circumferential row;

minimal and maximum pitches are adjacent to each other for each circumferential row: pitches increase alone the circumferential row according to an arithmetical progression selected for each circumferential row.

* * * * *